United States Patent [19]

McCoy

[11] Patent Number: 4,916,773

[45] Date of Patent: Apr. 17, 1990

[54] PAINT BRUSH WITH INTEGRAL CLEANING MEANS

[76] Inventor: Joseph H. McCoy, 4180 B. W. 118th, Hawthorne, Calif. 90250

[21] Appl. No.: 162,138

[22] Filed: Feb. 29, 1988

[51] Int. Cl.[4] ..... A46B 3/00

[52] U.S. Cl. ..... 15/191 A; 15/105; 15/193; 401/277

[58] Field of Search ..... 15/191 A, 191 R, 199, 15/105, 143 R, 192, 193; 401/291, 282, 287, 288, 289, 286, 277

[56] References Cited

U.S. PATENT DOCUMENTS

| | | | |
|---|---|---|---|
| D. 156,757 | 1/1950 | Muller-Munk | D4/133 |
| 821,968 | 5/1906 | Wiens | 401/282 |
| 1,928,929 | 10/1933 | Craig | 401/289 X |
| 2,814,815 | 12/1957 | Johnson | 401/277 X |
| 2,978,724 | 4/1961 | Gracian | 15/143 R X |
| 4,166,304 | 9/1979 | Flynn | 15/191 A X |

FOREIGN PATENT DOCUMENTS

| | | | |
|---|---|---|---|
| 2433546 | 1/1976 | Fed. Rep. of Germany | 15/105 |

*Primary Examiner*—Peter Feldman

*Attorney, Agent, or Firm*—Roger A. Marrs

[57] ABSTRACT

A paint brush is disclosed herein having an apertured block retaining the heel of a plurality of bristles. A frame is secured to the block on one end and secured to a handle on its other end so as to define a cavity between the block and the handle for storing a bristle cleansing fluid during a cleaning procedure. A cover removably or pivotally attaches to the frame for introducing a selected cleaning solution or compound. An illuminating device detachably couples with the frame directing an illuminating beam immediately ahead of the bristles and the handle is configured with a lazy "S" shape to accommodate the natural hand grip of the user's hand during a painting procedure.

1 Claim, 1 Drawing Sheet

PAINT BRUSH WITH INTEGRAL CLEANING MEANScl BACKGROUND OF THE INVENTION

1. Field of the Invention

The present invention relates to the field of painting implements and more particularly to a novel paint brush having means for accommodating a cleansing solution or compound useful in removing paint from the bristles of the brush during a cleansing procedure, as well as having illumination means and a handle conformal to the contour of the user's hand.

2. Brief Description of the Prior Art

In the past, it has been the conventional practice to employ a paint brush having a plurality of bristles outwardly depending from one end of a solid block and wherein the opposite end is attached to a straight handle. Problems and difficulties have been encountered with such a conventional brush inasmuch as the handle does not conform to the natural contour of the user's hands during a painting procedure and the work being painted may reside in a dark area so that the work area immediately ahead of the bristles is obscure to the vision of the painter. Perhaps a more difficult problem resides in the fact that it is extremely difficult to clean the bristles of paint or other residue after a painting procedure so that the bristles will be supple and useful for an additional time. It is a natural tendency for paint to reside in the heel of the brush or bristles adjacent to the block which, although it may be cleansed for a few times, constantly builds up so that an eventual hardened mass results. Such an occurrence renders the bristles useless since they become shorter and more stiff as the cake or mass builds.

In some instances, attempts have been made to introduce a pressurized fluid into the block of the brush so that the residue paint can be dislodged. Although this is effective, it is extremely expensive, cumbersome and is not a cleansing procedure which can be used at the paint site without specialized equipment and handling procedures.

Therefore, a long standing need has existed to provide a novel paint brush having internal means permitting the bristles of the brush to be thoroughly cleansed. Means can also be provided for illuminating the working ends of the bristles so that the immediate work site is visually clear to the painter and additional means may be incorporated into the handle so as to conform to the natural curvature of the painter's hand during a painting operation.

SUMMARY OF THE INVENTION

Accordingly, the above problems and difficulties are obviated by the present invention which provides a novel paint brush incorporating integral means for cleansing the bristles of the brush by providing an apertured block supporting a plurality of bristles into the form of a brush wherein the apertures provide a plurality or multiplicity of conduits available for communicating the opposite side of the block with the end of the block supporting the bristles. A frame is attached around the block having sidewalls that terminate at its opposite end in connection with the handle of the brush so as to define a chamber between the handle and the block into which a cleansing fluid, solution or compound can be introduced during a cleansing procedure. An access door is pivotally or removably attached to the frame for access to the storage cavity or chamber and the handle of the brush is contoured into a lazy "S" shape so as to accommodate the natural grip of the user.

Additionally, a feature of the present invention resides in incorporating a detachably mounted or permanently mounted illuminating means onto the handle and frame of the brush so that an illumination beam can be directed immediately ahead of th brush so that the work site is lighted.

Therefore, it is among the primary objects of the present invention to provide a novel paint brush having internal means for holding a quantity of cleansing solution arranged in communication with the bristles of the brush so that undesired paint can be cleaned from the bristles during a cleaning procedure.

Another object of the present invention is to provide a novel paint brush having a specifically contoured handle adapted to fit the natural grip of the user during a painting procedure so that the procedure is made more comfortable and so that the application of paint to the work surface can be more readily accommodated.

Still another object of the present invention is to provide a novel paint brush having illumination means integrally carried on the handle of the brush or detachably mounted to the frame or block of the brush so that an illuminating beam can be directed to the work site immediately ahead of the bristles.

Yet a further object of the present invention is to provide a novel paint brush having access means to a storage compartment introducing cleansing compounds and solutions thereto whereby the solution is in communication with the bristles of the brush during a cleansing procedure.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
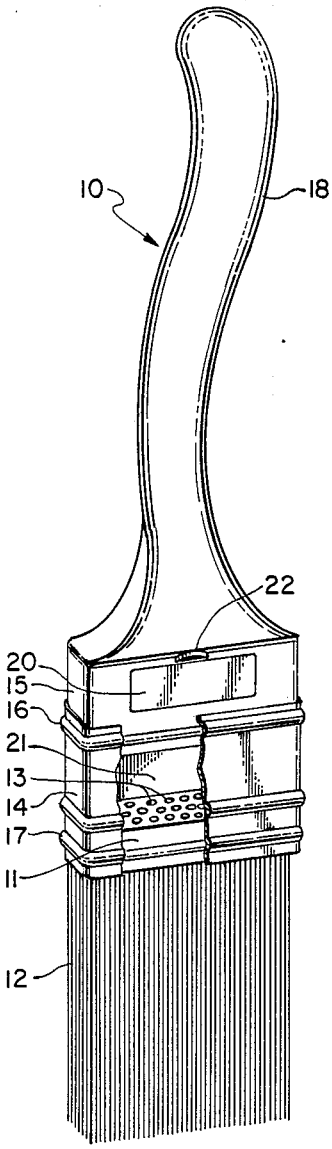
FIG. 1 is a front perspective view showing the novel paint brush incorporating the features of the present invention.

Referring in detail to FIG. 1, it can be seen that the novel paint brush of the present invention is illustrated in the general direction of arrow 10, which includes a block 11 having a plurality of bristles taking the form of a brush downwardly depending therefrom and illustrated by numeral 12. One end of all the bristles is held in securement to one side of the block 11 so that the ends of the bristles are in fluid communication with a plurality of apertures or openings, as illustrated by the numeral 13. The bristles 12 extend from one end of the block while the holes or apertures 13 are exposed from the opposite side of the block. A frame 14, including a continuous sidewall, is coupled at one end to the block 11 and is attached to a handle 15 on the other end. Such conventional connection may take the form of a ridge and bead attachment, indicated by numerals 16 and 17 respectively. This is a conventional means of coupling components together and does not form a part of the present invention.

The paint brush 10 further includes an elongated handle grip 18 which is shaped in the form of a lazy "S" shape so as to accommodate the user's hand during a painting procedure. An access door 20 is pivotally carried on the handle 15, or on the sidewall of the frame 14, which permits or gives access to a cavity 21 defined between the opposing ends of the handle 15 and the block 11. The cavity is further defined by the opposing side surfaces of the sidewall of the frame 14. Thereby, a quantity of cleansing solution or compound may be introduced into the storage compartment 21 via the access door 20. Preferably, the door includes a snap-lock latch 22 so that the door is maintained shut and sealed when the cleansing solution or compound is within the storage compartment.

Figure 2:
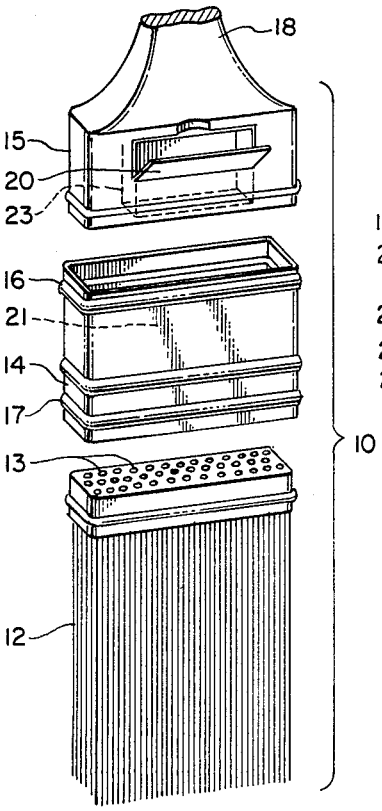
FIG. 2 is a perspective view similar to the view of FIG. 1 illustrated in an exploded form.

Referring now in detail to FIG. 2, it can be seen that the handle 15 not only includes the access door 20 but is provided with a channel 23 in fluid communication with the compartment 21. FIG. 2 also illustrates that the openings or apertures 13 are of sufficient diameter so as to not clog or collect residue during the cleaning procedure. The cleaning solution progresses through the holes or apertures through the heel of the brush and dissolves residue paint so that the residue may be extracted from the bristles.

Figure 3:
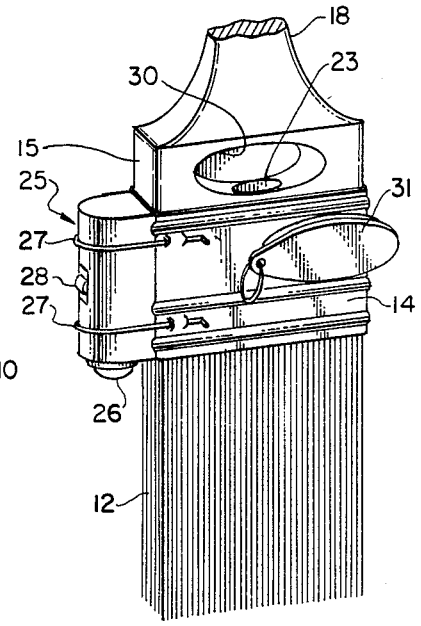
FIG. 3 is a front perspective view of another version of paint brush incorporating illumination means, as well as a removable access cover to the internal storage compartment.

Referring now in detail to FIG. 3, another version of the invention is illustrated in which the frame of the brush supports an illuminating device or means 25 so that a bulb 26 directs an illuminating beam immediately ahead of the bristles 12 during the painting procedure. The illuminating means 25 may be a self-contained unit attachable to the frame 14, as illustrated, such as by wires 27 and can include a conventional on-off button 28. However, it is to be understood that the illumination means may also be internally carried on the handle 15 so that internal batteries can be employed along with a lightbulb mounting which extends from the side of the frame, as illustrated. Furthermore, FIG. 3 shows that the opening 30 leading into the channel 23 of the handle 15 may be closed by a suitable cover or lid 31 that will seal the access opening when properly seated.

In view of the foregoing, it can be seen that the novel paint brush of the present invention provides not only a means for internally cleansing the heel and bristles of a brush but provides illumination means, as well as a comfortable grip for the hand of the user.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A paint brush comprising the combination of:

an elongated block having a plurality of open-ended apertures extending through said block between its opposite ends;

a plurality of bristles secured at one end to said block in close proximity to said plurality of apertures;

a frame member having a continuous sidewall defining an intense flushing chamber between its opposite and opposing inner surfaces in fluid communication with said open-ended apertures;

a handle carried on one end of said frame member and said block secured to the other end of said frame member so as to define a cleansing solution storage compartment between opposing ends of said handle and said block respectively;

an access opening in said handle and an internal channel communicating with said storage compartment;

means carried on said handle releasably closing said access opening in a sealing relationship with said handle;

a handle grip integrally formed with said handle having a lazy "S" shape conformal to the hand of the user for holding said handle during a painting procedure;

illumination means carried on said frame member for directing an illumination beam in a work site area immediately about said bristles;

said handle, said frame member and said block are integrally formed together as a unit; and said bristle ends are force-fitted into a portion of aid apertures whereby cleansing solution in said storage compartment and flushing chamber can engage with said bristle during a cleansing procedure.

* * * * *